US006763973B1

(12) United States Patent
Hudkins

(10) Patent No.: US 6,763,973 B1
(45) Date of Patent: Jul. 20, 2004

(54) SINGLE USE COLLAPSIBLE LIQUID CONTAINMENT VESSEL

(76) Inventor: Bruce Eric Hudkins, 1723 S. Madison Ave., Tulsa, OK (US) 74120

( * ) Notice: Subject to any disclaimer, the term of this patent is extended or adjusted under 35 U.S.C. 154(b) by 70 days.

(21) Appl. No.: 10/195,581

(22) Filed: Jul. 15, 2002

(51) Int. Cl.[7] ..... G01F 11/00

(52) U.S. Cl. ..... 222/1; 222/92; 222/143; 222/153.09; 222/209; 222/633

(58) Field of Search ..... 222/92, 143, 153.09, 222/209, 212, 570, 632, 633, 1

(56) References Cited

U.S. PATENT DOCUMENTS

| | | | | | |
|---|---|---|---|---|---|
| 3,083,877 | A | * | 4/1963 | Gash | 222/107 |
| 3,156,383 | A | | 11/1964 | Melli | 222/83 |
| 3,390,821 | A | * | 7/1968 | Mullan | 222/212 |
| 3,454,007 | A | | 7/1969 | Salis | 128/232 |
| 3,506,163 | A | * | 4/1970 | Rauh et al. | 222/212 |
| 4,147,279 | A | | 4/1979 | Matsui | 222/95 |
| 4,158,376 | A | | 6/1979 | Erb | 150/0.5 |
| 4,345,691 | A | | 8/1982 | Burke | 215/216 |
| 4,351,454 | A | | 9/1982 | Maynard, Jr. | 222/143 |
| 4,541,529 | A | * | 9/1985 | Hestehave et al. | 206/510 |
| 4,592,492 | A | * | 6/1986 | Tidmore | 222/209 |
| 4,921,147 | A | | 5/1990 | Poirier | 222/527 |
| 5,007,545 | A | | 4/1991 | Imbery, Jr. | 215/14 |
| 5,054,631 | A | | 10/1991 | Robbins, III | 215/1 A |
| 5,169,033 | A | | 12/1992 | Shay | 222/153 |
| 5,174,458 | A | | 12/1992 | Segati | 215/1 C |
| 5,207,250 | A | | 5/1993 | Tsao | 141/65 |
| 5,238,152 | A | | 8/1993 | Maas et al. | 222/153 |
| 5,255,808 | A | | 10/1993 | Tobler | 220/6 |
| 5,447,110 | A | | 9/1995 | Brown | 141/2 |
| 5,560,505 | A | | 10/1996 | Schneider et al. | 215/330 |
| 5,609,272 | A | | 3/1997 | Brass et al. | 222/147 |
| 5,813,577 | A | * | 9/1998 | Lee | 222/212 |
| 5,862,940 | A | | 1/1999 | Chism et al. | 220/666 |
| 5,873,496 | A | | 2/1999 | Montaner et al. | 222/153.09 |
| 6,047,848 | A | | 4/2000 | Davis | 220/666 |
| 6,334,543 | B1 | | 1/2002 | Abbondandolo | 220/666 |
| 6,378,736 | B1 | * | 4/2002 | Crosslin | 222/212 |

* cited by examiner

*Primary Examiner*—Joseph A. Kaufman
(74) *Attorney, Agent, or Firm*—Head, Johnson and Kachigian

(57) ABSTRACT

An expandable single use liquid containment vessel that can fit into restricted spaces such as the trunk or glove compartment of a passenger transport vehicle. The vessel contains a top and bottom wall integrally connected via an outer wall embodying accordion type pleats to allow for vessel compression and expansion. A single piece pouring nozzle is permanently attached to the containment vessel subsequent to introduction of a fluid the containment vessel's interior portion. One end of the filling nozzle secures the nozzle to the containment vessel. At the second end of the nozzle is an exiting orifice which has been dimensioned to preclude insertion therein of publicly accessible fueling nozzles commonly associated with motor vehicle refueling stations.

11 Claims, 3 Drawing Sheets

SINGLE USE COLLAPSIBLE LIQUID CONTAINMENT VESSEL

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

1. Field of the Invention

The present invention is related to a disposable expandable gasoline container. More specifically, the present invention provides a single use expandable container dimensioned to fit within a confined storage space of a motor vehicle.

2. Description of the Prior Art

Portable gasoline containers are designed to be carried by hand to transport gasoline or other motor fuels from a point of distribution to a point of use. Such containers typically require a pouring vent to facilitate free entry of air to replace fuel exiting the container. Conventional portable gasoline containers further include a spout through which gasoline, diesel or other motor fuel can be dispensed.

However, portable containers of the contemporary art fail to preclude the refilling of a portable container (herein synonymously referred to as "vessel" or "liquid containment vessel") when capping or closure means for securing the fuel within the container have been misplaced. Refueling of portable containers absent capping or secure closure means provide for a high degree of explosive potential. The instant invention via its novel combination of a nozzle which precludes insertion therein of a fueling apparatus and its (the nozzle's) permanent attachment to a single use disposable container obviates this potential hazard as well as facilitates commerce via repetitive purchase of such one time fueling vessels.

Further, conventional portable containers are bulky and can not fit in a glove compartment of a motor vehicle and/or are not suitable for storing, transporting and dispensing gasoline. Printed and published prior art does not provide a solution to these problems, as shown in the following U.S. Patents which were discovered in a patentability investigation: U.S. Pat. No. 2,950,029 to Winstead; U.S. Pat. No. 3,083,877 to Gash; U.S. Pat. No. 3,156,383 to Melli; U.S. Pat. No. 3,580,427 to Clarke; and U.S. Pat. No. 4,492,313 to Touzani.

U.S. Pat. No. 2,950,029 to Winstead teaches a substantially cubical container which is diagonally collapsible in order to provide the necessary draft for nesting purposes. The container is described as preferably being formed of a thermal plastic material, such as polyethylene.

U.S. Pat. No. 3,083,877 to Gash teaches a collapsible container with corrugated sides in order to collapse the container in an accordion like manner.

U.S. Pat. No. 3,156,383 to Melli teaches an expandable container which is primarily for a single use purpose. Though the container of Melli is clearly distinguishable from the instant invention in that the container is intended particularly to hold materials such as sodium hypochlorite or any other type of material that would prevent the container from being reused.

U.S. Pat. No. 3,580,427 to Clarke teaches a container having pleated walls with a lip type opening in order to dispense cream products, such as soaps, shaving creams, etc.

U.S. Pat. No. 4,492,313 to Touzani teaches a collapsible plastic bottle of circular bellows like configuration. The bellows fold to retain the folded condition without external assistance.

In consideration of the contemporary art cited herein and incorporated by reference in its entirety, neither independent reference or references cited in combination address deficiencies and hazards associated with non-secured, multiple refueling container operations.

Therefore, what is needed and what has been invented is a disposable expandable vessel that is capable of being stored in a glove compartment or trunk of a motor vehicle and capable of being expanded to be filled with gasoline or other motor fuel for a single use in the event that a motor vehicle runs out of gasoline.

SUMMARY OF THE INVENTION

The present invention accomplishes its desired objects by broadly providing an expandable liquid containment vessel that can fit into confined spaces such as the trunk, glove compartment or under seat portions of a passenger transport vehicle. The container consists of top and bottom walls connected via an outer wall having accordion type pleats extending from the top wall to the bottom wall with said accordion type pleats forming the outer and inner surfaces of the container's wall. Each of the accordion type pleats may be selectively expanded and contracted to expand/reduce the interior volume of the container. A circular depression is formed in a portion of the top wall of the vessel with the depression having a threaded projection formed therein. The projection, in turn, further comprises a first interlocking section for permanently attaching thereto a pouring nozzle. An optional venting orifice may be formed in the top wall. A single piece nozzle incorporates a threaded lower section and an upper section with a central bore traversing the internal portion of each the section and wherein the lower threaded section further comprises a second interlocking member to permanently engage the vessel's projection first interlocking section and wherein the outside diameter of the bore traversing the upper section is dimensioned to preclude insertion therein of a commercially available fueling nozzle.

The present invention also accomplishes its desired objects by broadly providing a method for adding gasoline, or other motor fuel to a fuel tank of a motor vehicle comprising the steps of:

(a) providing a motor vehicle having a compartment and a fuel tank; (b) disposing an expandable liquid containment vessel in said compartment, said expandable vessel comprising atop, a bottom and an outer wall having accordion type pleats extending from said top to said bottom, with said accordion type pleats forming the outer and inner surfaces of the vessel with each of said accordion type pleats being selectively expanded and contracted to expand/reduce the volume of the vessel; a circular depression formed in the top of the vessel, said depression having a threaded projection formed therein which further comprises at its base a first interlocking section for permanently attaching a pouring nozzle thereto a single piece nozzle having a threaded lower and an upper section; a central bore traversing the internal portion of each nozzle section and where the lower threaded section further comprises a second interlocking member to permanently engage said projection's first interlocking section and wherein the outside diameter of said bore traversing said upper section is dimensioned to preclude insertion therein of a commercially available fueling nozzle; (c) removing the gasoline container from the compartment of step (b); (d) expanding the removed gasoline container; (e) adding gasoline into the expanded gasoline container; (f) attaching the pouring nozzle; and (g) pouring gasoline from the gasoline container, through the attached nozzle and into the gas tank of a motor vehicle via a fueling aperture.

It is therefore an object of the present invention to provide a single use disposable expandable gasoline container.

It is another object of the present invention to provide a method for adding fuel to a gasoline tank of a motor vehicle.

These objects, together with the various ancillary objects and features which will become apparent to those skilled in the art as the following description proceeds, are attained by this novel liquid containment vessel and method, a preferred embodiment thereof shown with reference to the accompanying drawings, by way of example only, wherein:

DETAILED DESCRIPTION OF A PREFERRED EMBODIMENT

Figure 1:
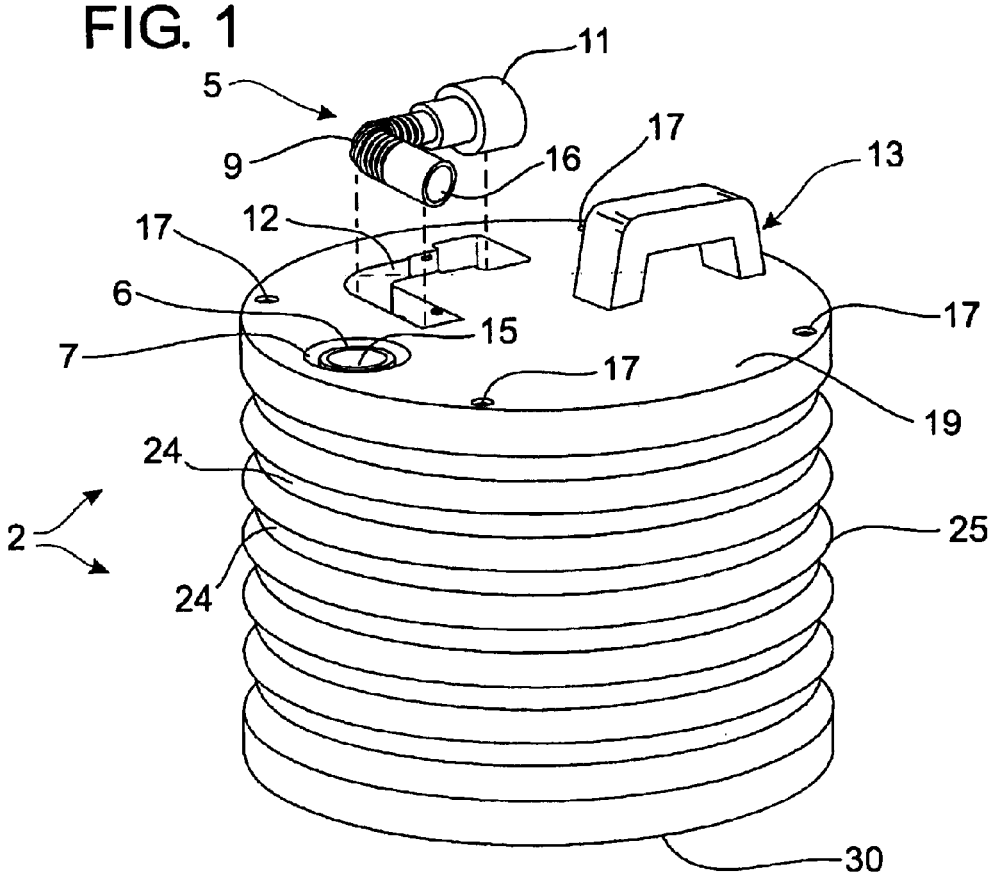
FIG. 1 is an isometric drawing of the instant invention illustrating expanded accordion-style pleats forming the outer surface of the vessel and further illustrating circular depression, single piece nozzle removal and handle portion positioned in the top wall of the instant invention.

Referring in detail the drawings wherein similar parts of the invention are identified by like reference numerals, there is seen an expandable liquid containment vessel that can fit into a confined spaces such as a trunk, glove compartment or underseat portion of a passenger transport vehicle. FIG. 1 provides greater detail with respect to said containment vessel. Turning now to FIG. 1.

In FIG. 1, an expandable, single use liquid containment vessel is generally illustrated as 2. The containment vessel is comprised of a top wall 19, a bottom wall 30 (not shown in detail in FIG. 1), an outer wall 24 which connects said upper wall 19 and lower wall 30 in a contiguous manner via accordion-type pleats 25, said pleats 25 forming the interior and exterior surfaces of the vessel with each of said accordion-type pleats 25 being selectively expandable and contractable to expand or reduce the volume of the vessel.

FIG. 1 further illustrates a circular depression 7 formed in the top wall of the vessel 19. Said depression 7 further comprises a threaded projection 6 formed within its diameter which further comprises a first interlocking section (not shown in FIG. 1) for permanently attaching a threaded lower section 11 of pouring nozzle 9 said locking means cooperatively interfaces with a second interlocking member section embodied within the internal portion of the nozzle section 11. Said threaded projection further comprising a fueling aperture 15 through which a motor fuel or other liquid may be introduced to the internal portion of said vessel 2.

For purposes for full and enabling disclosure, the invention may be practiced effectively with any one of many known interlocking screw-type means well known to those skilled in the art. Of particular significance and applicability, however, would be locking means similar to that disclosed in U.S. Pat. No. 4,345,691 entitled "Child Resistant Bottle Closure." Said patent reference U.S. Pat. No. 4,345,691 herein disclosed by reference in its entirety.

FIG. 1 also discloses a single piece nozzle generally illustrated as 5 which is comprised of a lower threaded section 11 and an upper section 9. A central bore 16 contiguously traverses the internal portion of each said nozzle section (9, 11). The outside diameter of said bore 16, at its widest point, is dimensioned to preclude insertion therein of a commercially available fueling nozzle such as those commonly encountered at motor vehicle refueling stations. That is, the invention may not be thwarted and used in a "refillable" fashion by inserting a commercially publicly accessible fueling nozzle within the center bore 16 of the invention's single piece nozzle 5.

In one embodiment of the instant invention, a carrying handle 13 is integrated on the top surface construction of the top wall 19. Lastly illustrated in FIG. 2 are female positioning, stacking positioners 17 which will be discussed further in association with FIG. 4.

Figure 2:
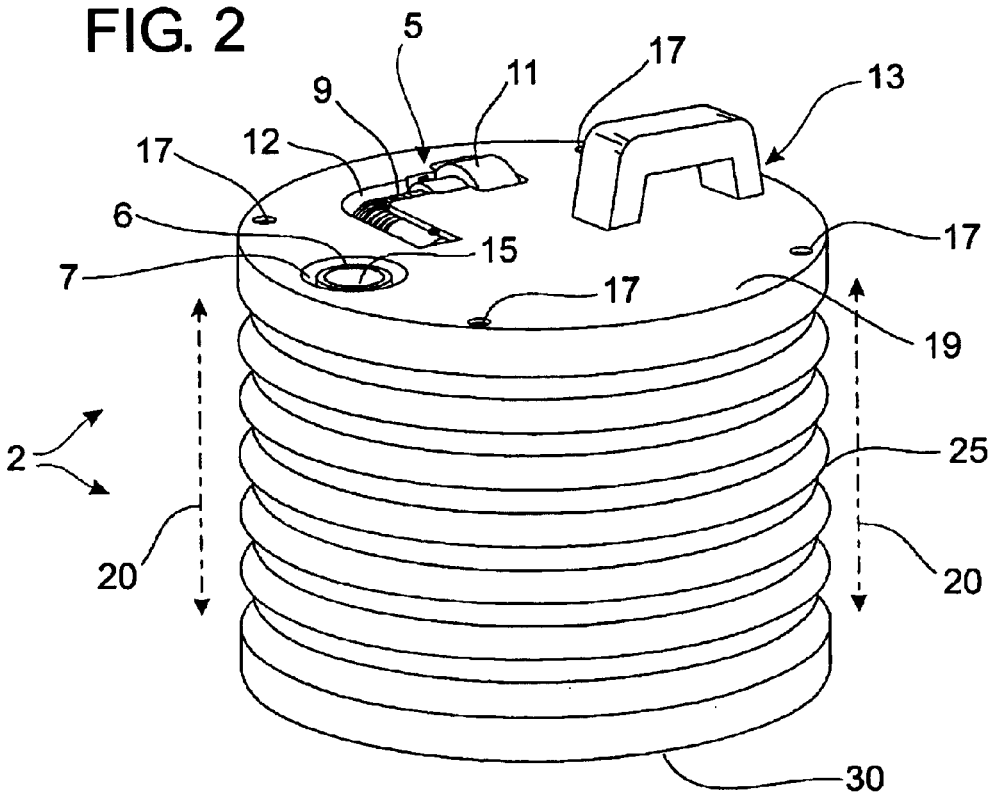
FIG. 2 is an isometric drawing of the liquid containment vessel of FIG. 1 and the top wall of the liquid containment vessel of FIG. 1 with nozzle positioned in place.

FIG. 2 illustrates an isometric illustration of the liquid containment vessel of FIG. 1 and the top wall of the liquid containment vessel of FIG. 1. In FIG. 2, the containment vessel 2 of the instant invention is illustrated in its expanded position wherein said expansion/contraction is indicated by lines 20.

FIG. 2 further discloses the nozzle of the instant invention positioned in its resting nozzle template 12 formed within the top wall 19 of the containment vessel 2. Said nozzle 5 and template 12 have been dimensioned such that the nozzle can be "snapped" into position via insertion of nozzle 5 into template 12.

Figure 3:
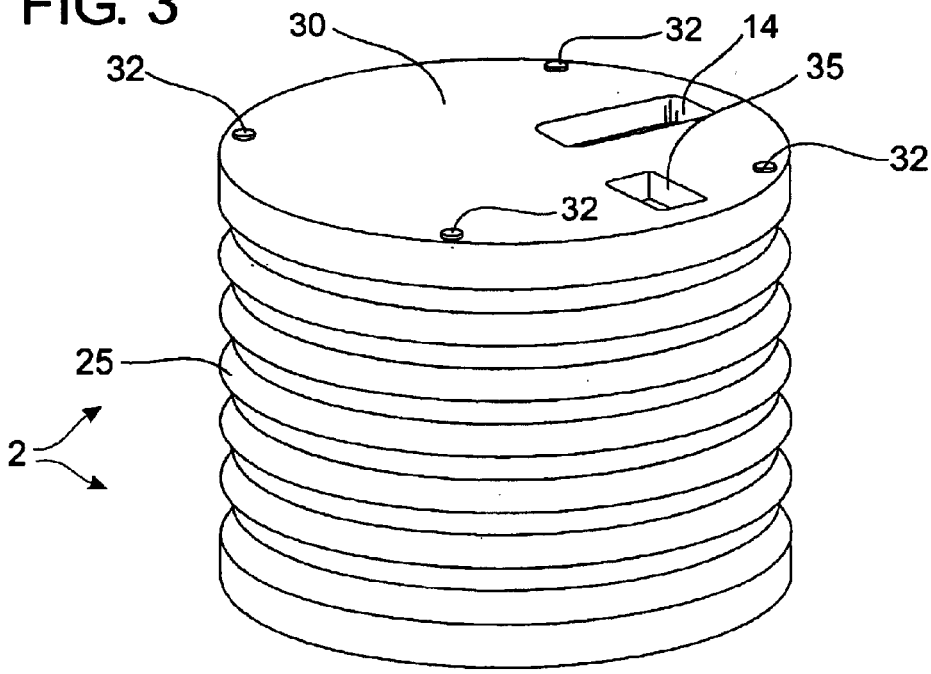
FIG. 3 is an isometric drawing of the liquid containment vessel of FIG. 1 illustrating the bottom wall of the liquid containment vessel of FIG. 1 wherein the nozzle's threaded lower section positioning divot and male stacking positioners are illustrated in further detail.

FIG. 3 illustrates an isometric illustration of the liquid containment vessel of FIG. 1.

FIG. 3, the bottom wall 30 of the instant invention 2 is illustrated detailing male stacking positioners 32 which when stacking more than one liquid containment vessel 2 upon another, are inserted into female positioners 17 as discussed in association with FIGS. 1 and 2. Further discussion and disclosure of vessel's stacking will be had in association with FIG. 4.

Continuing with FIG. 3, the bottom wall 30 of the instant invention further discloses a nozzle stacking divot 35 wherein when more than one embodiment of the instant invention is placed and positioned immediately above a second embodiment of the invention, the lower portion of the nozzle 11 is inserted into the divot 35 as a further means of alignment and stacking registration. Additionally illustrated in FIG. 3 is the invention's handle stacking divot 14 wherein more than one embodiment of the instant invention is placed in position immediately above a second embodiment. The handle's stacking divot 14 accommodates via insertion an immediately lower placed embodiments handle 13 (not illustrated in FIG. 3, illustrated in association and discussed in FIG. 4).

Figure 4:
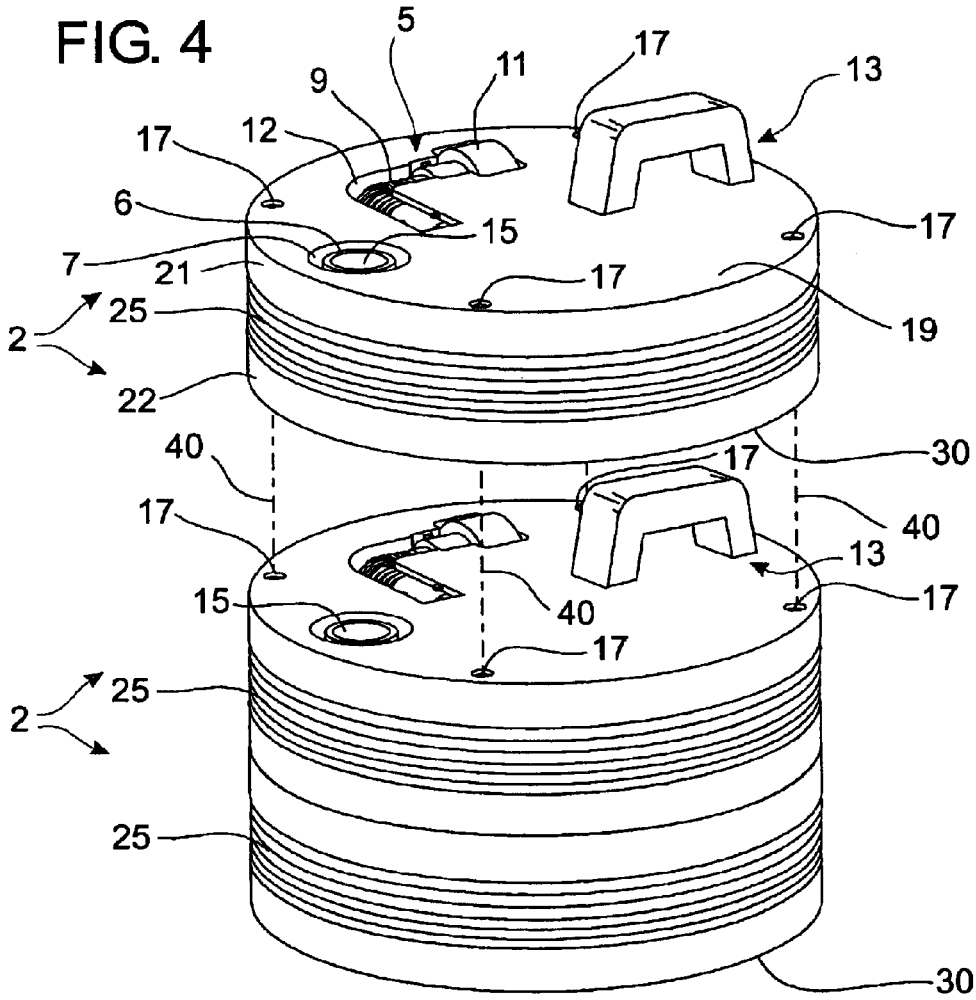
FIG. 4 is a drawing of the instant invention shown in a stacked positioning sequence in concert with at least one other stacked containment vessel.

FIG. 4 provides further detail with respect to the stacking of more than one containment vessel of the instant invention upon another. In FIG. 4 the instant invention anticipates retail sales of the instant invention wherein inventory stacking and retail purchase stacking are accommodated.

In FIG. 4, the invention is disclosed wherein its accordion-type pleats 25 are shown in a compressed format and the invention is being presented in alignment for stacked positioning. FIG. 4 clearly illustrates the invention's female stacking positioners 17 via aligned with the male stacking positioners 32 (not shown in FIG. 4). Such stacking occurs with the insertion of stacking positioners 32 positioned and inserted into female positioners 17 along movement lines 40. The invention clearly anticipates a vertical or horizontal stacked positioning to facilitate commercial presentation and ease of storage. FIG. 4 further illustrates the handle 13 of the instant invention position for insertion into the invention's handle stacking divot (not illustrated in FIG. 4, discussed and illustrated in association with FIG. 3).

Figure 5:
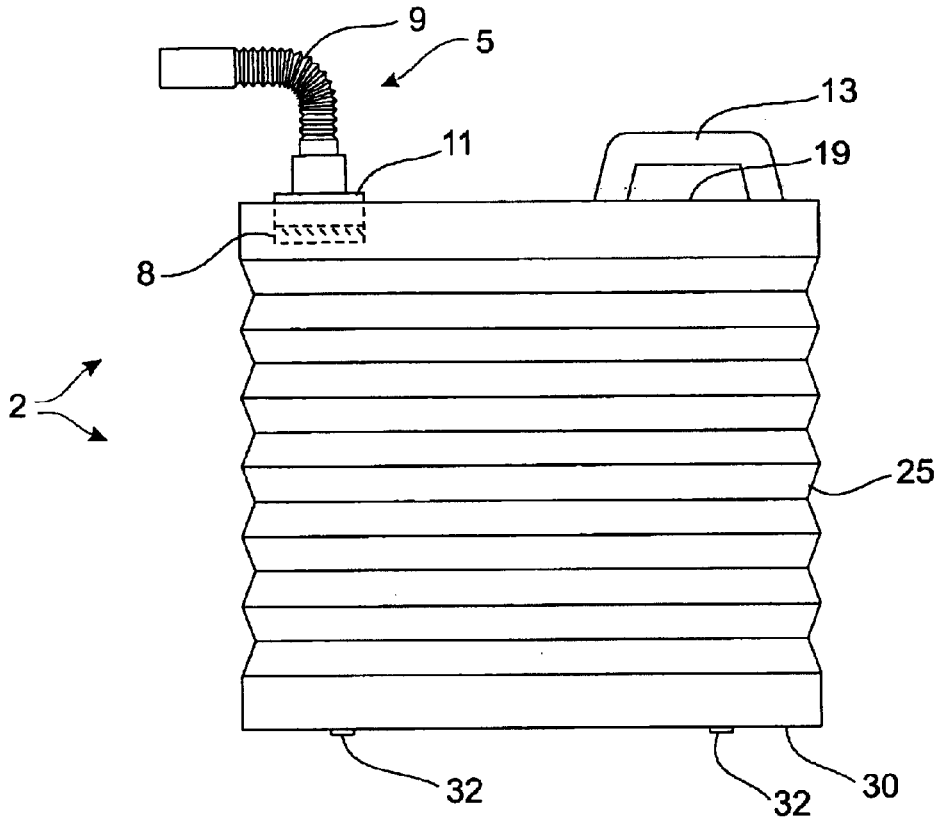
FIG. 5 is a side elevational view of the liquid containment vessel of the instant invention of FIG. 1.

FIG. 5 illustrates a side elevational view of the liquid containment vessel of the instant invention of FIG. 1.

In FIG. 5, the nozzle 5 of the instant invention is shown with its upper section 9 and lower section 11 in position and screwably attached to the containment vessel 2.

FIG. 5 illustrates at the lower portion of section 11, section 8 which is representative of securing means to ensure permanent attachment of said nozzle 5 to containment vessel 2.

Figure 6:
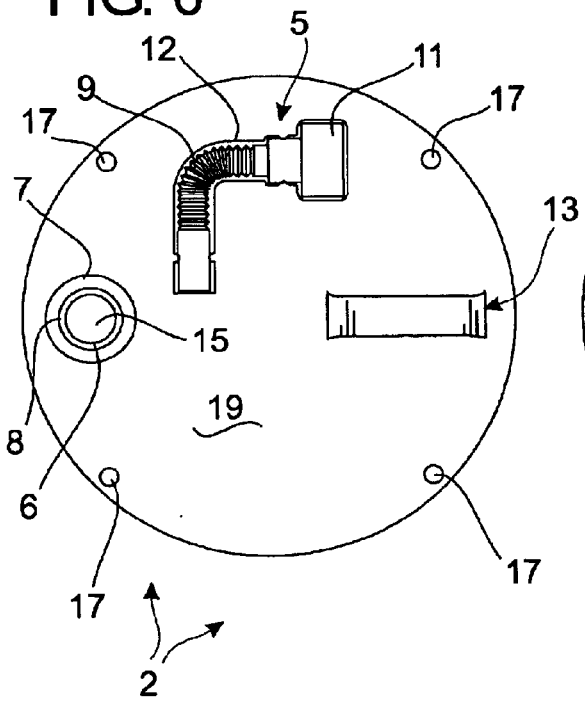
FIG. 6 is a top plan view of the liquid containment vessel of FIG. 5.

FIG. 6 illustrates top plan view of the liquid containment vessel of FIG. 5 and illustrates handle component 13; female stacking positioner means 17; nozzle 5 and circular depression 6 with threaded projection 7. For purposes of clarifying and disclosure, the circular depression 6 in the above noted embodies a fueling orifice whereby motor fuel or other similar like substances may be introduced into the internal portion of the instant invention.

Figure 7:
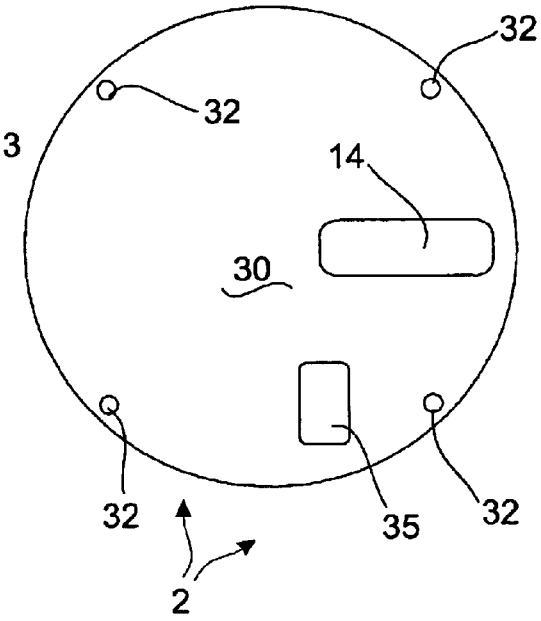
FIG. 7 is a bottom plan view of the liquid containment vessel of FIG. 5.

FIG. 7 illustrates a bottom plan view of the liquid containment vessel of FIG. 5.

In FIG. 7 the nozzle registration divot 35 is again presented for purposes of teaching and disclosure as are the male stacking positioners 32 which are either attached to or integrated as a portion of the invention lower bottom wall 30. Also illustrated in FIG. 7 is the invention's handle stacking divot 14.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

Alternate Embodiments

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. An expandable liquid containment vessel that can fit into confined spaces such as the trunk, glove compartment or under seat portions of a passenger transport vehicle, said container comprising of:

a top, a bottom and an outer wall having accordion type pleats extending from said top to said bottom with said accordion type pleats forming the outer surface of the vessel with each of said accordion type pleats being selectively expanded and contracted to expand/reduce the volume of the vessel;

a circular depression formed in the top of the vessel, said depression having a threaded projection formed therein which further comprises at its base a first interlocking section for permanently attaching a pouring nozzle thereto;

a single piece nozzle having a threaded lower section; and an upper section;

a central bore traversing the internal portion of each said section and wherein the lower threaded section further comprises a second interlocking member to permanently engage said projection's first interlocking section and wherein the outside diameter of said bore traversing said upper section is dimensioned to preclude insertion therein of a commercially available fueling nozzle.

2. The expandable liquid containment vessel as described in claim 1 wherein said top portion further comprises a handle portion.

3. The expandable liquid containment vessel as described in claim 1 wherein said top portion further comprises a venting orifice formed in said top.

4. The expandable liquid containment vessel as described in claim 1 wherein said single piece nozzle is attached to said top wall via a form fit attachment means.

5. The expandable liquid containment vessel as described in claim 1 wherein said single piece nozzle is attached to said top wall via a clamping attachment means.

6. The expandable liquid containment vessel as described in claim 1 wherein the outside diameter of said upper section is dimensioned to preclude insertion thereof within a publicly accessible fueling nozzle to form an essentially airtight connection thereto.

7. The expandable liquid containment vessel as described in claim 1 further comprising a handle stacking divot.

8. The expandable liquid containment vessel as described in claim 1 wherein said circular depression further comprises a fueling aperture.

9. A method for adding gasoline to a gasoline tank of a motor vehicle comprising the steps of:

(a) providing a motor vehicle having a compartment and a gas tank;

(b) disposing an expandable liquid containment vessel in said compartment, said expandable vessel comprising a top, a bottom and an outer wall having accordion type pleats extending from said top to said bottom, with said accordion type pleats forming the outer surface of the vessel with each of said accordion type pleats being selectively expanded and contracted to expand/reduce the volume of the vessel; a circular depression formed in the top of the vessel, said depression having a threaded projection formed therein which further comprises at its base a first interlocking section for permanently attaching a pouring nozzle thereto; a venting orifice formed in said top; a single piece nozzle having a threaded lower and an upper section; a central bore traversing the internal portion of each said section and where the lower threaded section further comprises a second interlocking member to permanently engage said projection's first interlocking section and wherein the outside diameter of said bore traversing said upper section is dimensioned to preclude insertion therein of a commercially available fueling nozzle;

(c) removing the gasoline container from the compartment of step (b);

(d) expanding the removed gasoline container;

(e) adding gasoline into the expanded gasoline container via a fueling aperture;

(f) attaching the pouring nozzle; and (g) pouring gasoline from the gasoline container, through the attached nozzle and into the gas tank of a motor vehicle.

10. The method of claim 9 wherein said compartment is a glove compartment.

11. The method of claim 9 wherein said compartment is a trunk of the motor vehicle.

* * * * *